US011330376B1

(12) United States Patent
Courtois et al.

(10) Patent No.: US 11,330,376 B1
(45) Date of Patent: May 10, 2022

(54) HEARING DEVICE WITH MULTIPLE DELAY PATHS

(71) Applicant: Sonova AG

(72) Inventors: Gilles Courtois, Uerikon (CH); Eleftheria Georganti, Zollikon (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/075,752

(22) Filed: Oct. 21, 2020

(51) Int. Cl.
*H04R 25/00* (2006.01)

(52) U.S. Cl.
CPC ..... *H04R 25/505* (2013.01)

(58) Field of Classification Search
CPC .. H04R 25/505; H04R 25/552; H04R 25/558; H04R 25/70; H04R 2225/43; H04R 2225/41; H04R 2460/01
See application file for complete search history.

(56) References Cited

U.S. PATENT DOCUMENTS 5,210,803 A * 5/1993 Martin ..... H04R 25/505 381/315
6,130,950 A * 10/2000 Martin ..... H04R 25/70 381/312
8,385,864 B2 2/2013 Dickson et al.
10,142,741 B2 11/2018 Aubreville et al.
2014/0050340 A1* 2/2014 Meyer ..... H04R 25/50 381/321
2018/0192209 A1* 7/2018 Chen ..... H04R 25/552
2020/0021923 A1 1/2020 Elmedyb et al.
2021/0297792 A1* 9/2021 Ma ..... H04R 25/505

FOREIGN PATENT DOCUMENTS

EP 1801786 B1 12/2014
EP 3432305 A1 1/2019

* cited by examiner

*Primary Examiner* — Tuan D Nguyen
(74) *Attorney, Agent, or Firm* — ALG Intellectual Property, LLC

(57) ABSTRACT

The disclosed technology generally relates to a hearing device configured to process a signal in a first path and a second path, where the first path and second path apply different digital signal processing operations to the signal. The hearing device is configured to determine a relatedness factor that compares the processed signals along the first and second path. Based on the relatedness factor, the hearing device can apply different gains to the signal in the first and second paths. The hearing device can output a combined signal based on the signals from the first and second paths. In some embodiments, the second path can be associated with receiving a signal from an external device.

20 Claims, 6 Drawing Sheets

HEARING DEVICE WITH MULTIPLE DELAY PATHS

TECHNICAL FIELD

The disclosed technology generally relates to a hearing device and operations for processing sound in the hearing device. More specifically, the disclosed technology relates to first and second processing paths for a hearing device, where sound is processed differently along each path and gain is applied separately to audio signals in each path to improve sound quality for a hearing device user.

BACKGROUND

A hearing device is a device that a user can wear on an ear or around a user's head. The hearing device can provide audio or audio signals for the hearing device user. Some example hearing devices include hearing aids, headphones, earphones, hearing protection devices, earbuds, personal sound amplifiers, earpieces, assistive listening devices, a cochlear device (includes a device part and an implant part), or any combination thereof. More specific to hearing aids, a hearing aid is a device that provides amplification, attenuation, or frequency modification of audio signals to compensate for hearing loss or difficulty; some example hearing aids include a Behind-the-Ear (BTE), Receiver-in-the-Canal (RIC), In-the-Ear (ITE), Completely-in-the-Canal (CIC), Invisible-in-the-Canal (IIC) hearing aids. A hearing aid can be a prescription device or non-prescription device.

Further, the introduction of digital hearing devices, as opposed to analog hearing devices, has resulted in improvements to hearing performance in part because of advanced signal processing. For example, digital hearing devices can implement noise reduction, which can remove noise from a signal in the frequency domain. Other advanced digital signal processing algorithms include sound classification, and feedback cancellation, which can all improve a hearing experience for a hearing device user beyond basic analog operations. Additionally, another type of advanced processing is neural network sound processing, which can include using a neural network, deep neural network, or other network comprises nodes.

Although advanced signal processing techniques have improved a hearing experience for hearing device users, the advanced signal processing techniques introduce latency that may cause reduced sound quality in the output signal of the hearing device. Specifically, if an output signal has a low latency component (e.g., a delay of 1 millisecond or less) and a high latency component (e.g., greater than 1 millisecond), the mixing of these two signal components in the output signal of a hearing device can cause a comb-filter effect. The comb-filter effect results from constructive and/or destructive interference(s) in the output signal that may cause a hearing device user to have a poor listening experience. For example, a hearing device user may hear an unpleasant "swishing" sound when an output signal has a comb-filter effect. This poor output audio can be especially unpleasant for hearing device users experiencing mild-to-moderate hearing loss.

Accordingly, there exists a need to provide technology that allows a user to hear output signals with components that are based on signals with different delays and/or provide additional benefits.

SUMMARY

This summary is provided to introduce a selection of concepts in a simplified form that are further described below in the Detailed Description. This summary is not intended to identify key features of the claimed subject matter.

The disclosed technology relates to a hearing device. The hearing device can comprise a microphone configured to produce a microphone signal; a processor electronically coupled to the microphone; and a memory, electronically coupled to the processor, that can store instructions that when executed by the processor cause the hearing device to perform operations. The operations can be considered an algorithm to reduce a comb-filter effect in an output signal of the hearing device.

The operations can comprise: processing the microphone signal in a first path and a second path, wherein the first path is associated with applying a first operation (e.g., applying a frequency-dependent gain) to the microphone signal and the second path is associated with applying a second operation (e.g., noise cancelation, neural network operation, and/or noise reduction) to the microphone signal. The first and second operations can be different signal processing operations, wherein the second operation has a longer delay or latency than the first operation (e.g., because of the more advanced digital signal processing technique applied in the second path).

The operations can further include determining a relatedness factor that compares relatedness of the processed microphone signal in the first path to the processed microphone signal in the second path; generating a first output by applying a first gain to the processed microphone signal in the first path based on the relatedness factor; generating a second output by applying a second gain to the processed microphone signal in the second path based on the relatedness factor; and providing a combined output signal based on the first and second outputs. The operations can also further include processing the microphone signal along a third and fourth path, and applying a third and fourth gain to the respective paths.

The disclosed technology also comprises a method for carrying out the operations and a non-transitory computer-readable medium for storing the operations. The non-transitory computer-readable medium can be in a hearing device (e.g., hearing aid).

In some implementations, the hearing device can communicate with an external device. The external device (e.g., a wireless microphone or mobile phone) can provide a separate signal for processing in the second path. The hearing device can determine the relatedness between the signal processed in the first path of the hearing device and the external signal processed in the second path of the hearing device. Although the implementations disclose first and second processing paths, the disclosed technology can include multiple paths (e.g., 3, 4, 5, or more).

Figure 1:
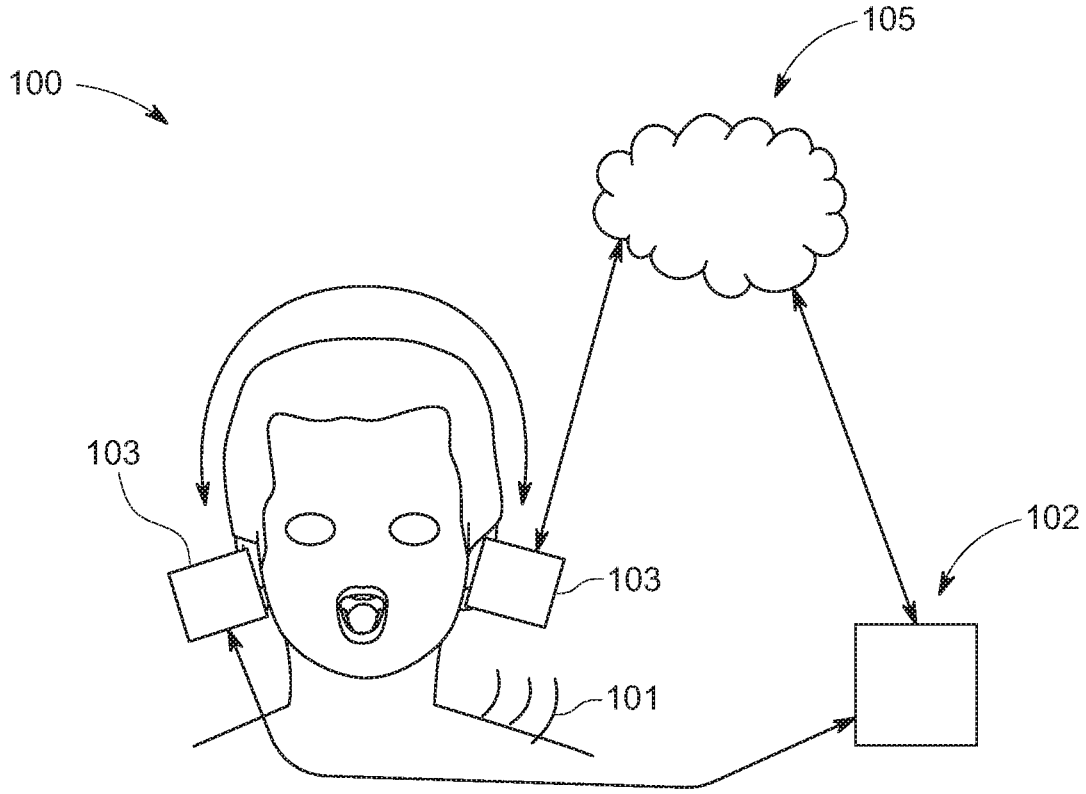
FIG. 1 illustrates a communication environment with a hearing device user wearing two hearing devices in accordance with some implementations of the disclosed technology.

The drawings are not to scale. Some components or operations may be separated into different blocks or combined into a single block for the purposes of discussion of some of the disclosed technology. Moreover, while the technology is amenable to various modifications and alternative forms, specific implementations have been shown by way of example in the drawings and are described in detail below. The intention, however, is not to limit the technology to the selected implementations described. On the contrary, the technology is intended to cover all modifications, equivalents, and alternatives falling within the scope of the technology as defined by the appended claims.

DETAILED DESCRIPTION

To improve a hearing experience for a hearing device user, the disclosed technology includes a hearing device that is configured to reduce an unwanted comb-filter effect from delayed signals that are combined in an output signal. Specifically, the hearing device can apply different signal processing operations along different signal processing paths and apply gains separately in these paths depending on the relatedness of the signals in these two different paths to reduce an unwanted comb-filter effect (or other undesired effects).

In some implementations, the hearing device applies a simple processing operation such as frequency-dependent gain operation along a first path, which generally has a short delay, and a more advanced signal processing operation such as noise reduction, which generally has a longer delay, on the second path. The more advanced signal processing operation can provide a better speech intelligibility or listening experience compared to the simple signal processing operation in the first path. Yet, the more advanced signal processing operation may have an increased delay, which may provide a less positive hearing experience. Further, in some cases, the signal in the first path provides a sufficient sound quality even compared to the advanced signal processing path, which may mean the additional delay does not provide an additional benefit. The hearing device can provide a combined output signal based on the first and second paths, but this may result in a low-quality sound output based on the different delays. The hearing device can also include more than just two paths, e.g., it can include third or four paths, where different gain can be applied accordingly to each path.

To improve sound quality and reduce the comb-filter effect, the hearing device can compare the signals in each path based on a relatedness factor while the signals are being processed on the first and second path. If the relatedness factor is high, which likely indicates a comb-filter effect in an output signal, the hearing device can reduce the gain out of the long-delay path to reduce the comb-filter effect in the output signal. If the relatedness factor is low, the hearing device can determine that the long-delay path likely includes a signal that has been significantly enhanced despite an increased delay, and it can output a combined signal based on the first and second path, where the gain out of the first path is low and the gain out of the second path is high (e.g., to emphasize the higher quality sound in the second processing path). For example, a long-latency may be caused by a hard denoising in the second signal processing path. The benefits brought by the long-latency processing may be significant, and the associated output signals should be favored.

Figure 2:
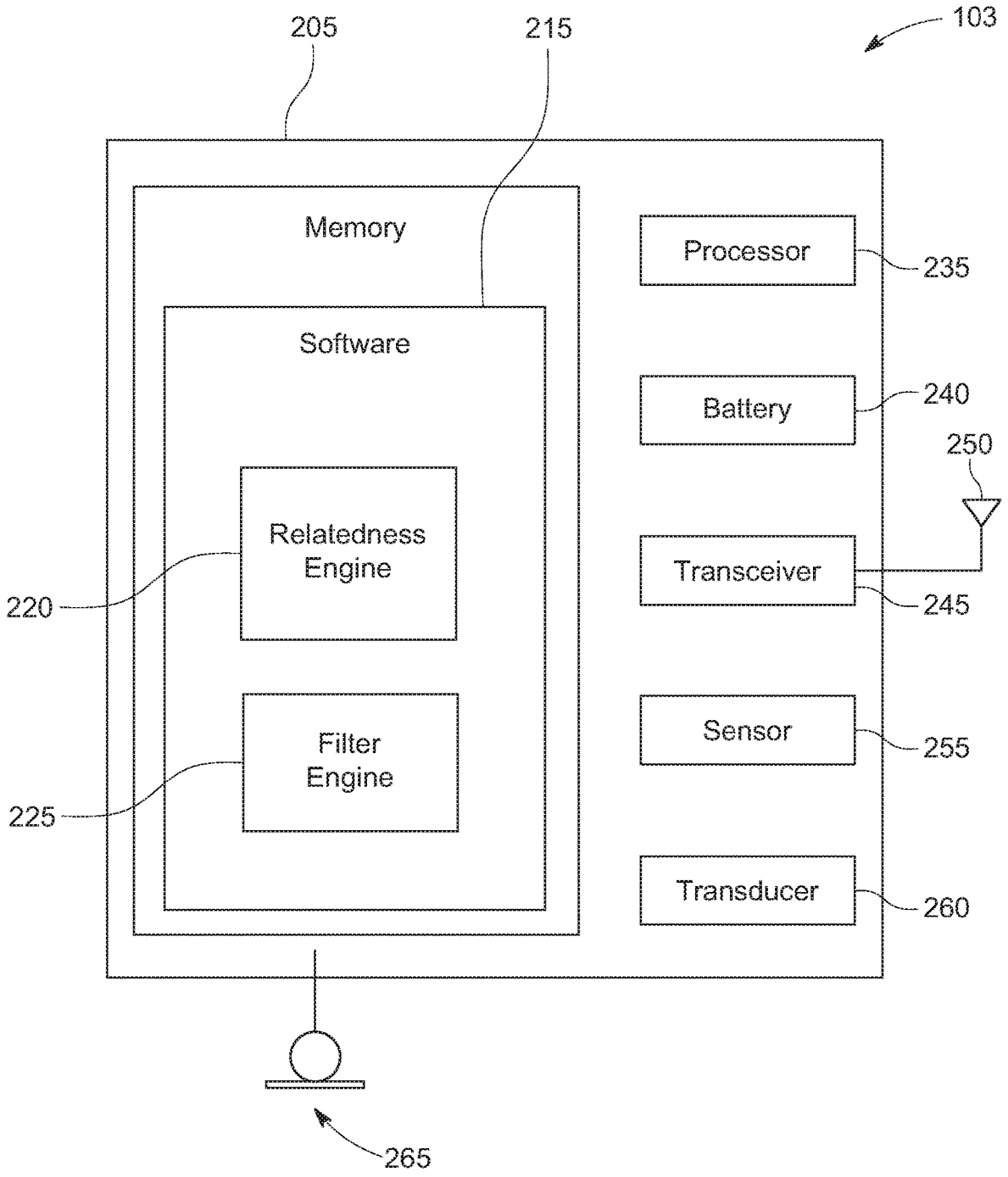
FIG. 2 illustrates a hearing device from FIG. 1 in more detail in accordance with some implementations of the disclosed technology.

The relatedness factor can be associated with different values. In some implementations, the relatedness factor is associated with short-term coherence that is computed based on a filtered signal from the first path and computing its short-term coherence values using a Fast Fourier Transform. The short-term coherence values can be compared to the frequency-domain processing values of the second path to determine a relatedness factor. FIG. 2 provides more detail regarding the short-term coherence values. In some implementations, the relatedness factor can be associated with spectral standard deviation of the signal in the first path and the second path, and/or higher moments of the signals in first path and second path.

In some implementations, the first and second path can be based on a received microphone signal from the microphone(s) of the hearing device. In other implementations, the first path can receive its input signal from the microphone(s) of the hearing device and the second path can receive its input signal from an external device, e.g., based on a Bluetooth™ wireless connection with the external device. For example, a mobile phone can transmit an audio signal to the hearing device, where the audio signal was processed based on an application on the mobile phone.

The disclosed technology can have a technical benefit or address a technical problem for hearing device sound quality. Specifically, the hearing device can implement algorithms of operations that require a long delay in addition to algorithms or operations that require a short delay while reducing the negative impact on sound quality.

There are some terms used throughout this detailed description that are defined here. A low-latency path or low-delay path generally means a path with low delay. The low-latency path has low-delay because a basic or simple digital signal operation is applied in that path such as time-domain beamformer, transducer compensations, frequency-dependent gains, and/or automatic gain control. A long-latency path or long-delay path generally means a path with high delay (higher than the low-latency path). The long-latency path is associated with more advanced signal processing operations such as neural network computations, denoising, noise cancelation, and/or sound classification. The first signal processing path (also referred to as the "first path") is generally associated with the low-latency path and the second signal processing path (also referred to as the "second path") is associated with long-latency path.

FIG. 1 illustrates a communication environment 100. The communication environment 100 includes hearing devices 103 (singular "hearing device 103" or multiple "hearing devices 103") and wireless communication devices 102 (singular "wireless communication device 102" and multiple "wireless communication devices 102"). The hearing device user can receive audio or audio signals from the communication environment 100, e.g., from his or her own voice 101 or from other sounds (e.g., music, voices, noise, and/or other sounds). Based on received sound and/or communication with other devices, the hearing devices 103 can provide processed audio or audio signals to a hearing device user. For example, as further explained in FIGS. 2, 3A, 3B, 4, 5, and 6, the hearing devices 103 can apply different gains to different signal processing paths of the hearing devices 103 so that the comb-filter effect in an output signal of the hearing devices is reduced.

As shown by double-headed bold arrows in FIG. 1, the wireless communication devices 102 and the hearing devices 103 can communicate wirelessly. Wireless communication includes wirelessly transmitting information, wirelessly receiving information, or both. Each wireless communication device 102 can communicate with each hearing device 103 and each hearing device 103 can communicate with the other hearing device. Wireless communication can include using a protocol such as Bluetooth Basic Rate/Enhanced Rate (BR/EDR), Bluetooth Low Energy™, a proprietary protocol communication (e.g., binaural communication protocol between hearing devices), ZigBee™, Wi-Fi™, or an Industry of Electrical and Electronic Engineers (IEEE) wireless communication standard. The wireless communication devices 102 can provide the hearing devices 103 with audio signals.

The wireless communication devices 102 shown in FIG. 1 can include mobile computing devices (e.g., mobile phone or tablet), computers (e.g., desktop or laptop), televisions (TVs) or components in communication with television (e.g., TV streamer), a car audio system or circuitry within the car, tablet, remote control, remote microphone, an accessory electronic device, a wireless speaker, or watch. The wireless communication devices 102 can be referred to as an "external device" because it is external to the hearing device. The external device can transmit wireless signals to the hearing devices 103. In some implementations, the wireless communication device 102 can implement a neural network and provide computations to the hearing devices 103.

The network 105 is a communication network. The network 105 enables the hearing devices 103 or the wireless communication devices 102 to communicate with a network or other devices. In some implementations, the hearing devices 103 or the wireless communication 102 can offload processing to devices via the network 105 (e.g., neural network computation, training of neural networks). The network 105 can be a Wi-Fi™ network, a wired network, or e.g. a network implementing any of the Institute of Electrical and Electronic Engineers (IEEE) 802.11 standards. The network 105 can be a single network, multiple networks, or multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. In some implementations, the network 105 can include communication networks such as a Global System for Mobile (GSM) mobile communications network, a code/time division multiple access (CDMA/TDMA) mobile communications network, a $3^{rd}$, $4^{th}$ or $5^{th}$ generation (3G/4G/5G) mobile communications network (e.g., General Packet Radio Service (GPRS)) or other communications network such as a Wireless Local Area Network (WLAN).

FIG. 2 is a block diagram illustrating the hearing device 103. FIG. 2 illustrates the hearing device 103 with a memory 205, software 215 stored in the memory 205, the software 215 includes a relatedness engine 220 and a filter engine 225. The hearing device 103 in FIG. 2 also has a processor 235, a battery 240, a transceiver 245 coupled to an antenna 250, a sensor 255, a transducer 260, and a microphone 265. The hearing device 103 shown in FIG. 2 can implement different processing algorithms in a first processing path and a second processing path as disclosed in FIGS. 3A, 4, 5, and 6. Each of these components is described below in more detail.

The memory 205 stores instructions for executing the software 215 comprised of one or more modules, data utilized by the modules, or algorithms. The modules or algorithms perform certain methods or functions for the hearing device 103 and can include components, subcomponents, or other logical entities that assist with or enable the performance of these methods or functions (e.g., in executing process 600 disclosed in FIG. 6). Although a single memory 205 is shown in FIG. 2, the hearing device 103 can have multiple memories 205 that are partitioned or separated, where each memory can store different information.

The relatedness engine 220 can determine a relatedness factor between signals being processed in first and second paths of the hearing device. See FIGS. 3A, 4, and 5 for examples the first and second processing paths, where the hearing device applies different operations to the signal in the first and second paths. The relatedness engine 220 can calculate the relatedness factor while the signals are being processed in the first and second path, when the signals first enter the first and second paths or shortly after entering, or after the first and second signals have been partially processed in the first and second paths.

In some implementations, the relatedness engine 220 can determine a relatedness factor based on transforming a time-domain signal in the first processing path into the frequency domain to compute short-term coherence values and receiving short-term coherence values for the processed signal in the second path. The short-term coherence is defined at frame index k and frequency index i as:

$$\Gamma_{S_1S_2}[k,i]=\frac{\phi_{S_1S_2}[k,i]}{\sqrt{\phi_{S_1S_1}[k,i]\phi_{S_2S_2}[k,i]}}$$

where the quantities $\phi_{S_1S_2}$ (cross power spectral density), ($\phi_{S_1S_1}$, and $\phi_{S_2S_2}$, (power spectral density) are obtained by averaging over time, for example:

$$\phi_{S_1S_2}[k,i]=\lambda\phi_{S_1S_2}[k-1,i]+(1-\lambda)S_1[k,i]S^*_2[k,i]$$

$$\phi_{S_1S_1}[k,i]=\lambda\phi_{S_1S_1}[k-1,i]+(1-\lambda)|S_1[k,i]|^2$$

$$\phi_{S_2S_2}[k,i]=\lambda\phi_{S_2S_2}[k-1,i]+(1-\lambda)|S_2[k,i]|^2$$

Where $\phi_{S_1}$ is the short-time Fourier transform (STFT) of the output signal of the first (lower-latency) signal path, $\phi_{S_2}$ is the STFT outputted by the second (longer-latency) processing path and $\lambda$ is related to a time constant that controls the speed of the smoothing.

An additional option for detecting the resemblance between the signals associated to the low- and long-latency paths could be performed by computing other statistical metrics in the frequency domain (e.g., the spectral standard deviation), as shown below:

$$\sigma_1=\left[\frac{1}{n_f-n_j+1}\sum_{i=n_j}^{n_f}(20\log_{10}|S_1[k,i]|-\mu_1)^2\right]^{\frac{1}{2}}$$

-continued $$\sigma_2 = \left[\frac{1}{n_f - n_j + 1}\sum_{i=n_j}^{n_f}(20\log_{10}|S_2[k, i]| - \mu_2)^2\right]^{\frac{1}{2}}$$

where $$\mu_2 = [\frac{1}{n_f - n_j + 1}\sum_{i=n_j}^{n_f} 20\log_{10}|S_2[k, i]|$$

$$\mu_1 = [\frac{1}{n_f - n_j + 1}\sum_{i=n_j}^{n_f} 20\log_{10}|S_1[k, i]|$$

Similarly, other statistical quantities (e.g., higher moments) could be calculated such as the kurtosis. In such a case, these statistical values can be fully computed on the corresponding signal path (e.g., a first path with low-latency and as second path with long-latency) and only their respective values should be compared with each other to detect their similarities.

The filter engine 225 can apply different filtering operations to signals in the hearing device (e.g., in the first path and second path). In some implementations, the filter engine 225 applies a biquadratic filter to an audio signal. The filter engine 225 can apply other types of active or passive filters to audio signals. Although the filter engine 225 is shown as a separate box in the memory 205, the filter engine 225 can be include in digital signal processor (DSP) or other parts of the hearing device 103.

The processor 235 can include special-purpose hardware such as application specific integrated circuits (ASICs), programmable logic devices (PLDs), field-programmable gate arrays (FPGAs), programmable circuitry (e.g., one or more microprocessors microcontrollers), DSP, neural network engines, appropriately programmed with software and/or computer code, or a combination of special purpose hardware and programmable circuitry. Especially, neural network engines might be analog or digital in nature and contain single or multiple layers of feedforward or feedback neuron structures with short and long-term memory and/or different nonlinear functions.

Also, although the processor 235 is shown as a separate unit in FIG. 2, the processor 235 can be on a single chip with the transceiver 245, and the memory 305. The processor 235 can also include a DSP configured to modify audio signals based on hearing loss or hearing programs stored in the memory 205. Alternatively, or additionally, the processor 235 can communicate with a DSP that is on a separate or different chip to implement digital signal processing algorithms. In some implementations, the hearing device 103 can have multiple processors, where the multiple processors can be physically coupled to the hearing device 103 and configured to communicate with each other.

The battery 240 can be a rechargeable battery (e.g., lithium ion battery) or a non-rechargeable battery (e.g., Zinc-Air) and the battery 240 can provide electrical power to the hearing device 103 or its components. In general, the battery 240 has less available capacity than a battery in a larger computing device (e.g., a factor 100 less than a mobile phone device and a factor 1000 less than a laptop).

The antenna 250 can be configured for operation in unlicensed bands such as Industrial, Scientific, and Medical Band (ISM) using a frequency of 2.4 GHz. The antenna 360 can also be configured to operation in other frequency bands such as 5.8 GHz, 3.8 MHz, 10.6 MHz, or other unlicensed bands.

The sensor 255 can be an accelerometer, medical sensor, photodiode sensor, temperature sensor, pressure sensor, capacitive sensor, a mechanical sensor configured to detect touch, or a magnetic sensor. If the sensor is an accelerometer, it can be positioned inside or on the outside of the hearing device and detect acceleration changes of the hearing device. The accelerometer can be a capacitive accelerometer, a piezoelectric accelerometer, or another type of accelerometer. In some implementations, the accelerometer can measure acceleration along only a single axis. In other implementations, the accelerometer can sense acceleration along two axes or three axes. In some implementations, the hearing device 103 can use outputs from the sensor 255 to adjust processing techniques. For example, the hearing device 103 can adjust digital signal processing techniques based on detected acceleration of the hearing device or other medical information received from the sensor 255.

The transducer 260 can provide an output signal. The transducer 260 can be a loudspeaker or part of a cochlear device to transmit audio signals to a cochlear implant. The output signal can be a combined output from first and second paths. The output signal (also referred to as the "combined output signal") can be audio or an audio signal. For example, the output signal can be the output of a loudspeaker that provides sound to the ear canal of a hearing device user. As another example, the hearing device 103 can transmit output signals through the skin of a hearing device user into the user's cochlear implant. Although a single transducer 260 is shown in FIG. 2, the disclosed technology can have more than one transducer 260 in hearing device 103.

The microphone 265 is configured to capture sound and provide an audio signal of the captured sound to the processor 235. The microphone 265 can also convert sound into audio signals. The processor 235 can modify the sound (e.g., in a DSP) and provide the processed audio derived from the modified sound to a user of the hearing device 103. Although a single microphone 265 is shown in FIG. 2, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphones to perform beam forming operations. In such an example, the processor 235 would include a DSP configured to perform beam forming operations.

Figure 3A:
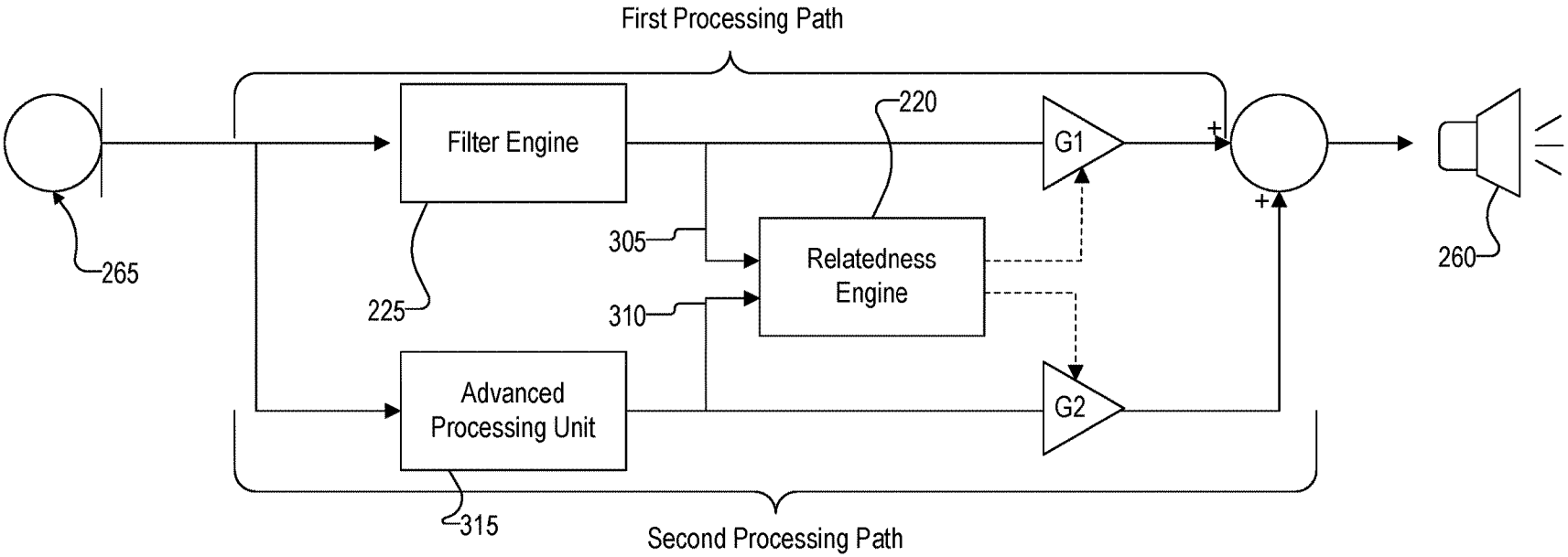
FIG. 3A is a schematic block diagram illustrating the hearing device from FIG. 1 in accordance with some implementations of the disclosed technology.

FIG. 3A is a schematic block diagram illustrating the hearing device from FIG. 1. On the left side of FIG. 3A, the microphone 265 shows that sound can be received at the hearing device 103 via the microphone 265, and the microphone 265 can convert a sound wave to a microphone signal that is fed into the filter engine 225 and/or the advanced processing unit 315. The filter engine 225 can apply basic filtering operations as disclosed in FIG. 2 such as biquadratic filtering. The advanced processing unit 315 can apply more advanced processing operations such as noise cancelation, noise reduction, neural network processing, or another network processing operation. The second processing path generally has a longer delay than the first processing path due at least in part to the advanced processing unit 315 applying advanced signal processing operations, but the signal in the second path can be higher sound quality due to the advanced processing (e.g., a hard denoising of a noisy signal). A "G1" can be applied to the first path and a "G2"

can be applied to the second path. In some implementations, if the signals have a high-relatedness, then the G1 is a value and G2 can be 1-G2. If the signals have a low-relatedness, then G1 is a low value and G2 is a high value.

As shown by side branches 305 and 310, information about the signals from the first and second processing paths can be transmitted to the relatedness engine 220. In some implementations, the filter engine 225 applies a FFT to a processed signal in the first path and provides the result of the FFT to the relatedness engine 220 via the side branch 305. Similarly, the advanced processing unit can apply an FFT to the processed signal in the second path and provides the result of this FFT to the relatedness engine 220 via the side branch 310.

The relatedness engine 220 can calculation and compare the short-term coherence factors (or other factors as disclosed in FIG. 2) to determine a relatedness value that determines the resemblance between the processed signal in the first path and the processed signal in the second path. The relatedness engine 220 can then transmit a signal to adjust a first time-frequency-dependent gain (e.g., "G1") associated with the gain of the processed signal in the first path and a second (time-frequency dependent) gain associated with a second gain of the processed signal in the second path (e.g., G2). The relationship of the gain applied to the processed signal in the first path can be different than the gain applied to the process signal in the second path as disclosed FIG. 3B. In some implementations, where the signals have a relatedness, G2=1-G1.

Figure 3B:
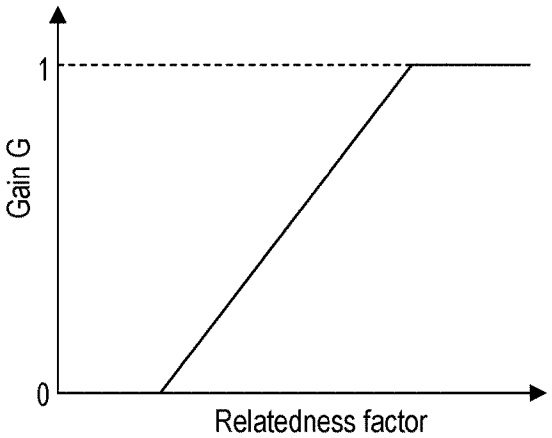
FIG. 3B is a graph illustrating a relationship between gain for a hearing device and a relatedness factor in accordance with some implementations of the disclosed technology.

FIG. 3B is a graph illustrating a relationship between gain for a hearing device and a relatedness factor. The graph is typical of the relationship between the relatedness factor and the gain applied to a signal in a low-latency path. The y-axis of the graph relates to gain applied to a signal. The gain is a ratio of amplification calculated based on dividing the desired output signal level by the input signal level. The range of gain can be from 0 to 1. The x-axis relates to the relatedness factor, which is disclosed with respect to FIG. 2. The graph illustrates a gain scheme that applies a high gain to a low-latency signal when signals are related (e.g., a high relatedness factor).

In general, if the signal in the first path and the second path have a high relatedness factor (e.g., close to 1), this indicates a high resemblance between the signals associated to the low- and long-latency paths (e.g., the first processing path and the second processing paths). In such a case, the processing performed in the frequency domain is likely to be rather linear and involve few noise reduction strategies (e.g., in the second path). Also, the low-latency processing is expected to be sufficient to ensure a suitable audibility and speech intelligibility and is therefore favored by a high gain, while the long-latency path is attenuated. Accordingly, a high gain is applied to the low-latency signal and a complementary low gain is applied to the long-latency signal (e.g., in the second path).

On the contrary, a low coherence value (close to 0) indicates that both signals are significantly different, which occurs if the frequency domain processing involves non-linear operations and/or possibly a high amount of denoising. In that case, it is preferable to emphasize the long-latency path with a high gain and attenuate the low-latency path with a complementary low gain. Accordingly, a low gain is applied to the low-latency signal and a complementary high gain is applied to the long-latency signal (e.g., in the second path).

Figure 4:
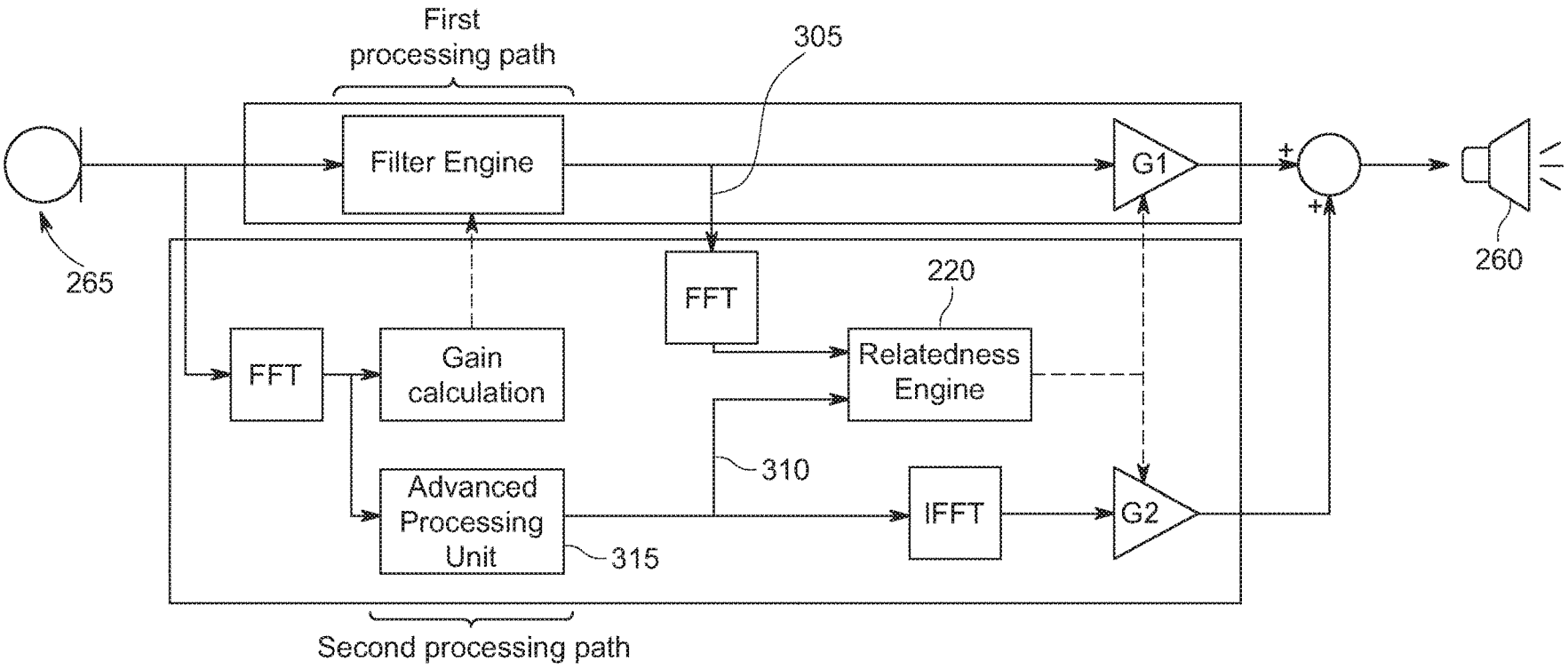
FIG. 4 is a schematic block diagram illustrating a hearing device in accordance with some implementations of the disclosed technology.

FIG. 4 is a block flow diagram illustrating a hearing device, which is similar to FIG. 3A, but has more detail. Specifically, FIG. 4 includes a Fast Fourier Transform (FFT), gain calculation, and an inverse Fast Fourier Transform (IFFT) to convert a signal from the frequency domain to the time domain. FIG. 4 illustrates that the side branch 305 can be used to calculate an FFT for the processed signal in the first path and a side branch 310 in the second path and can provide the FFT values to the relatedness engine 220. The relatedness engine 220 can then determine the appropriate gain as described in FIG. 3B for each processed signal in the first path and the second path.

Figure 5:
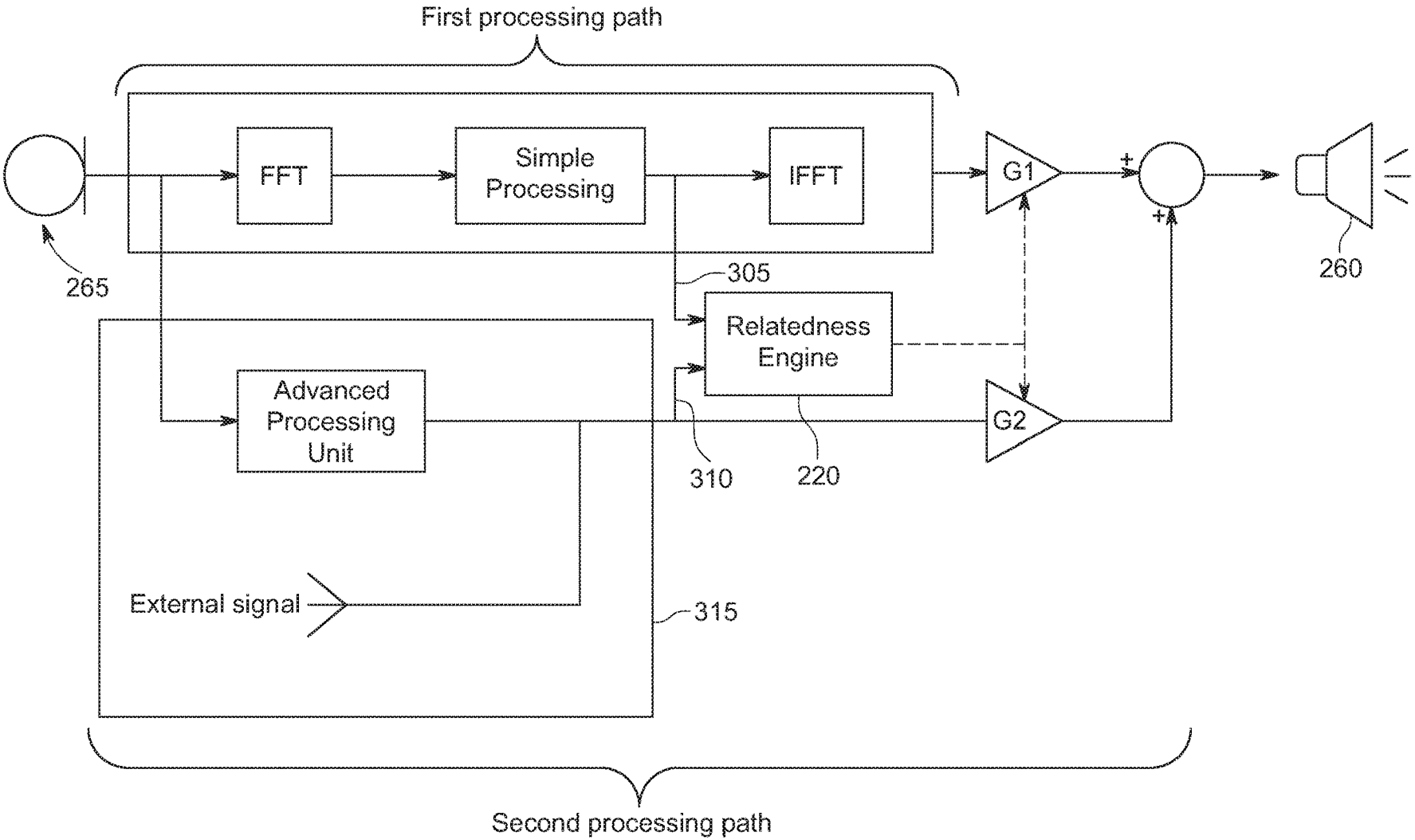
FIG. 5 is another schematic block diagram illustrating a hearing device in accordance with some implementations of the disclosed technology.

FIG. 5 is another schematic block diagram illustrating a hearing device (e.g., the hearing device 103 from FIG. 1). FIG. 5 is similar to FIG. 3A and FIG. 4, but FIG. 5 includes a signal that received from an external device via the transceiver 245 and the antenna 250 (e.g., the external device can be the wireless communication device 102 from FIG. 1). The first processing path in FIG. 5 can include processing operations that have short delay (e.g., less than 1 milliseconds) or medium delay (e.g., around 7 milliseconds). The second signal processing path in can include processing operations that have longer delay (e.g., greater than 1 millisecond). Additionally, because the signal from the external microphone is received wirelessly, it may introduce more delay into the processing of the signal in the second processing path. FIG. 5 also shows IFFT to convert signals from the frequency domain back to the time domain. The relatedness engine 220 computes the short-term coherence from the FFT or other signal characteristics to determine how coherent or related the processed signals in the first path are compared to the second path. The relatedness engine 220 can then apply the appropriate gain (e.g., same as FIG. 3B) depending on the relatedness of the signals in the processing paths.

Figure 6:
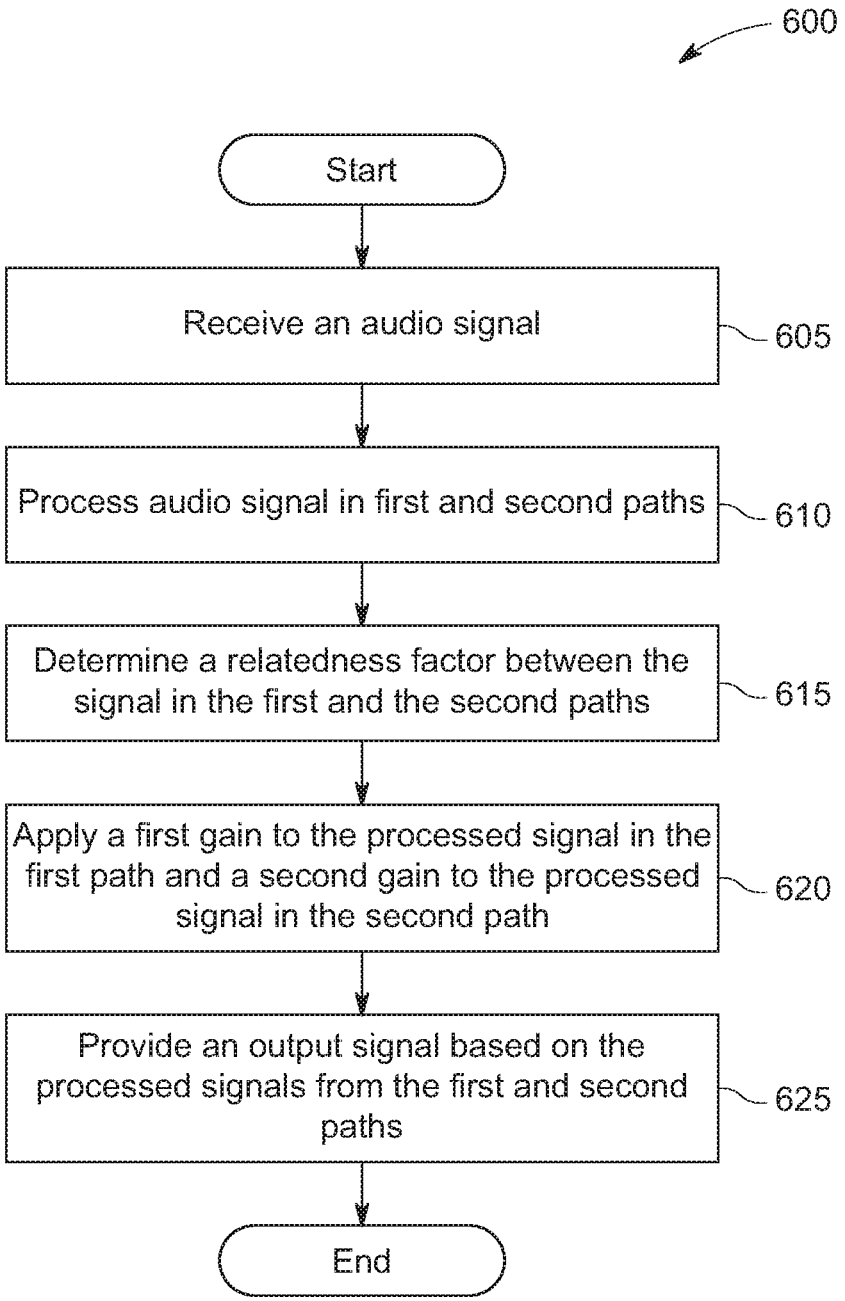
FIG. 6 is a process flow diagram illustrating a process for processing sound in accordance with some implementations of the disclosed technology.

FIG. 6 illustrates a block flow diagram for a process 600 for processing audio signal in a hearing device. The hearing device 103 can perform part or all of the process 600. Also, the hearing device 103 in combination with another device (e.g., the wireless communication device 102 from FIG. 2) can perform the process 600. The process 600 is considered an algorithm to improve sound output of a hearing device.

At receive audio signal operation 605, the hearing device (e.g., the hearing device 103, FIG. 1) receives an audio signal. The hearing device can receive an audio signal from its microphone or from an external device (e.g., the wireless communication device 102, FIG. 1). If received at a microphone, the microphone can convert audio or sound into a microphone signal and the microphone signal can be transmitted to the processor for further digital signal processing. If received from an external device, the processor of the hearing device can process the signal further or simply mix it with the sound provided by its transducer. External signals can include signals from external microphones, audio from mobile phone applications, or audio from a mobile phone (e.g., music, voice, telephone call, etc.).

At process an audio signal operation 610, the hearing device can process the receive audio along a first and second path as disclosed in FIGS. 2, 3A, 3B, 4, and 5. The first path can include simple processing operations such as frequency dependent gain, beamforming, and/or filtering. The second path can include advanced signal processing operations such as noise cancelation, feedback cancellation, or neural network computations. In the implementations where the microphone receives an audio signal from an external device, the second path can handle the processing of the external signal. Because the first path can apply different digital signal processing operations than the second path, there can be a delay when comparing the processed signal in the first path to the processed signal in the second path. If the second path requires a lot of processing time for an intensive operation (e.g., noise cancellation or receiving a signal from an external device via Bluetooth LE™), there can be a long delay (e.g., 20 milliseconds).

At determine relatedness factor operation 615, the hearing device determines the relatedness between the processed signal in the first path and the processed signal in the second path. As discussed in FIG. 2A, the hearing device can determine a relatedness factor based on different metrics. For example, the hearing device can use a FFT values on a side branch of the first path and FFT values from the second path and uses the FFT values from both paths to compute relatedness factor. Other computations can be used as disclosed in FIG. 2, e.g., spectral standard deviation.

At apply gain operation 620, the hearing device applies gain to the processed signal in the first path and the processed signal in the second path. If the relatedness between the two signals is high, a high gain is applied to the signal in the first path and a low gain is applied to the signal in the second path because the probability of a comb-filter effect (or other undesired effect) is high due to combining it with the long-latency of the signal in the second path. Applying the higher gain to the first signal and a low gain to the second signal can result in less artifacts. Alternatively, if the relatedness between the two signals is low, a low gain is applied to the first processed signal and a high gain is applied to the second processed signal. Based on the different gains applied, the processed signal in the second path will be easier to hear for the user and this can be a benefit as the second signal path applied more processing that resulted in a larger change than the first signal processing path to improve the signal.

At output operation 625, the hearing device outputs a combined signal based on the first and second outputs from the first and second signal processing paths. The combined output signal is provided after the gain operation 620 so that the combined output signal includes an appropriate gain for the desired signal and complementary gain for the undesired signal. The output operation 625 can include provide the signal to a loudspeaker in the hearing device or provide audio signals that are transmitted to a cochlear implant portion for electrical stimulation of a nerve to simulate hearing. After the output operation 625, the process 600 can be repeated entirely, repeated partially (e.g., repeat only operation 615), or stop.

Aspects and implementations of the process 600 of the disclosure have been disclosed in the general context of various steps and operations. A variety of these steps and operations may be performed by hardware components or may be embodied in computer-executable instructions, which may be used to cause a general-purpose or special-purpose processor (e.g., in a computer, server, or other computing device) programmed with the instructions to perform the steps or operations. For example, the steps or operations may be performed by a combination of hardware, software, and/or firmware such with a wireless communication device or a hearing device.

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, read-only memory (ROM), random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is a non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

The invention claimed is:

1. A hearing device comprising:

a microphone configured to produce a microphone signal;

a processor electronically coupled to the microphone;

a memory, electronically coupled to the processor, storing instructions that when executed by the processor cause the hearing device to perform operations, the operations comprising:

processing the microphone signal in a first path and a second path, wherein the first path is associated with applying a first operation to the microphone signal and the second path is associated with applying a second operation to the microphone signal, wherein the first and second operations are different signal processing operations, wherein the second operation has a longer latency than the first operation, determining a relatedness factor that compares relatedness of the processed microphone signal in the first path to the processed microphone signal in the second path;

generating a first output by applying a first gain to the processed microphone signal in the first path based on the relatedness factor;

generating a second output by applying a second gain to the processed microphone signal in the second path based on the relatedness factor; and providing a combined output signal based on the first and second outputs.

2. The hearing device of claim 1, wherein the operations further comprise:

determining that the relatedness factor is high; and based on determining the relatedness factor is high, setting the first gain to a high value and setting the second gain to a low value.

3. The hearing device of claim 2, wherein a high relatedness factor is associated with a value close to 1.

4. The hearing device of claim 1, wherein the operations further comprise:

determining that the relatedness factor is low; and based on determining the relatedness factor is low, setting the first gain to a low value and setting the second gain to a high value.

5. The hearing device of claim 4, wherein a low relatedness factor is associated with a value close to 0.

6. The hearing device of claim 1, wherein the first operation includes at least one of the following:

frequency-dependent gain;

beamforming;

biquadratic filtering; or a combination therefore.

7. The hearing device of claim 1, wherein the second operation includes at least one of the following:

noise reduction;

feedback cancelation;

applying a neural network; or a combination therefore.

8. The hearing device of claim 1, wherein the relatedness factor is associated short-term coherence of the processed microphone signal.

9. The hearing device of claim 1, wherein the relatedness factor is associated spectral standard deviation, kurtosis, or higher moments of a processed signal.

10. The hearing device of claim 1, wherein determining the relatedness factor further comprises: computing the relatedness factor in sub-bands.

11. The hearing device of claim 1, wherein the first path has a segment associated with a time domain and the second path is associated with a frequency domain.

12. A method to operate a hearing device, the method comprising:

processing a microphone signal in a first path and a second path, wherein the first path is associated with applying a first operation to the microphone signal and the second path is associated with applying a second operation to the microphone signal, wherein the first and second operations are different operations, wherein the second operation has a longer delay than the first operation, determining a relatedness factor that compares relatedness of the processed microphone signal in the first path to the processed microphone signal in the second path;

generating a first output by applying a first gain to the processed microphone signal in the first path based on the relatedness factor;

generating a second output by applying a second gain to the processed microphone signal in the second path based on the relatedness factor; and providing a combined output signal based on the first and second outputs.

13. The method of claim 12, the method further comprising:

determining that the relatedness factor is high; and based on determining the relatedness factor is high, setting the first gain to a high value and setting the second gain to a low value.

14. The method of claim 12, further comprising:

determining that the relatedness factor is low; and based on determining the relatedness factor is low, setting the first gain to a low value and setting the second gain to a high value.

15. A non-transitory computer-readable medium storing instructions that when executed by a processor cause a hearing device to perform operations, the operations comprising:

receiving, at a hearing device, an external signal from an external device;

processing, in the hearing device, a microphone signal in a first path and processing the external signal in a second path, wherein the first path is associated with applying a first operation to the microphone signal and the second path is associated with applying a second operation to the external signal, wherein the first and second operations are different operations, determining a relatedness factor that compares relatedness of the processed microphone signal in the first path to the processed microphone signal in the second path;

generating a first output by applying a first gain to the processed microphone signal in the first path based on the relatedness factor;

generating a second output by applying a second gain to the processed microphone signal in the second path based on the relatedness factor; and providing a combined output signal based on the first and second outputs.

16. The non-transitory computer readable medium of claim 15, wherein the external device is a remote microphone or a mobile computing device.

17. The non-transitory computer readable medium of claim 16, wherein the external signal includes short-term coherence factors.

18. The non-transitory computer readable medium of claim 16, wherein the operations further comprise:

determining that the relatedness factor is high; and based on determining the relatedness factor is high, setting the first gain to a high value and setting the second gain to a low value.

19. The non-transitory computer readable medium of claim 15, the operations further comprising:

determining that the relatedness factor is low; and based on determining the relatedness factor is low, setting the first gain to a low value and setting the second gain to a high value.

20. The non-transitory computer readable medium of claim 15, the operations further comprising:

frequency-dependent gain;

beamforming;

biquadratic filtering; or a combination therefore.

* * * * *